US007354012B2

(12) United States Patent
Huang

(10) Patent No.: US 7,354,012 B2
(45) Date of Patent: Apr. 8, 2008

(54) ROUND UNDULATING BLADE AND BLADE MODULE FOR SHREDDER

(75) Inventor: Simon Huang, SanChung (TW)

(73) Assignee: Milchilin Prosperity Co., Ltd., Taipei Hsien (TW)

( * ) Notice: Subject to any disclaimer, the term of this patent is extended or adjusted under 35 U.S.C. 154(b) by 49 days.

(21) Appl. No.: 11/296,399

(22) Filed: Dec. 8, 2005

(65) Prior Publication Data

US 2006/0138266 A1 Jun. 29, 2006

Related U.S. Application Data

(63) Continuation-in-part of application No. 10/721,422, filed on Nov. 26, 2003, now Pat. No. 7,044,410.

(51) Int. Cl.
*B02C 18/16* (2006.01)

(52) U.S. Cl. ..... 241/295; 241/236

(58) Field of Classification Search ..... 241/236, 241/295, 294

See application file for complete search history.

(56) References Cited

U.S. PATENT DOCUMENTS 6,695,240 B2 * 2/2004 Rajewski ..... 241/236

* cited by examiner

*Primary Examiner*—Mark Rosenbaum
(74) *Attorney, Agent, or Firm*—Lowe Hauptman Ham & Berner, LLP

(57) ABSTRACT

The present invention relates to a round undulating blade for shredder, where a sheet metal is integrally formed into a round undulating blade to serve as the blades for constructing a blade module. The blade includes: a periphery; an undulating blade flank including at least two cambers having a first curvature and at least two cambers having a second curvature alternatively arranged with respect to the cambers having the first curvature; and hooked edges formed on the periphery of the cambers having the first curvature, wherein the undulating blade flank of the blade serves to cut paper along a longitudinal direction to form paper strips having double-tapering end, and the hooked edges serve to cut the strips along a horizontal direction into paper chips. These characteristics help to reduce the manufacturing cost, reduce the motor load and power consumption, to thereby enhance the market competitiveness.

9 Claims, 14 Drawing Sheets

ROUND UNDULATING BLADE AND BLADE MODULE FOR SHREDDER

CROSS-REFERENCES TO RELATED APPLICATIONS

This application is a Continuation-in-part application of U.S. Ser. No. 10/721,422, which was filed on Nov. 26, 2003, now U.S. Pat. No. 7,044,410.

STATEMENT REGARDING FEDERALLY SPONSORED RESEARCH OR DEVELOPMENT

Not Applicable

DESCRIPTION

1. Filed of the Invention

The present invention relates to an improved cutting blade for a shredder, particularly to a round undulating blade that is integrally formed by punching a sheet metal in a punching die or a round undulating blade module that is integrally formed by die-casting.

2. Background of the Invention

The conventional shredders for cutting paper use a plurality of cutting blades and spacers engaging over a rotary cutter shaft, and the shearing force that two parallel and opposite rotary cutter shafts produce for transferring and cutting the paper-to-be-cut along a longitudinal direction into strips. Shredders can be classed into two types, the stripe-cut shredders and crosscut shredders, according to the machine cutting style. The former shredders arrange cutting blades to the rotating cutter shafts in a manner to cutting the paper in a longitudinal direction to form strips. The later shredders include blades that include more than one cutting edge part, and each cutter is disposed helically along the rotary cutter shaft for first cutting paper along a horizontal direction into strips and then cutting paper along a longitudinal direction into approximate 4 mm×40 mm paper chips.

By referring to the assembled perspective view of a conventional blade illustrated in FIG. 1 and a planar view showing the operation of the conventional blade in FIG. 2, the conventional blade is made by punching a sheet metal having a thickness of approximately 2 mm into a circular blade by a die. The blade includes a polygonal central hole A1 through which a rotary shaft may pass. The blade also includes cutting edges A2 that are spaced in about 120 degrees apart around the periphery. As shown, when two blades are arranged on the rotary shafts S in a back-to-back manner to combine into a set of blades A, the cutting edges of the two blades assume a V-like edge A3. The opposite rotary shafts S' space the two blades apart by space rings (not shown) in a face-to-face manner to form a set of blade A'. When the paper to be cut passes through the two reverse rotary shafts S, S', the opposing rotation of the periphery of the blades, that is, flanks A4 and flanks A4, will cut the paper like scissors. The opposing rotation of cutting edges A2 and the opposite flanks A4 will then cut the paper along a horizontal direction into 4 mm×40 mm paper chips.

During operating of the conventional blades, to ensure smooth cutting of the paper along the horizontal direction, sharp blades with proper orientations are needed. However, because the blades are formed by a punch die, the die wear that increases with the time will reduce sharpness of the blade edges, which does not improve until replacing the die, to result in inconsistent quality. To ensure quality of the blades, it is necessary to shorten the service term of the die, which results in increment of the cost. In addition, in the conventional blades, the thickness of the blade is the same as the width of paper to be cut. To ensure the strength of blades while cutting along the horizontal direction, the blades cannot be too thin, or else the blades tend to deform or fracture. Such a limitation attributes to the high material cost, which is less competitive as compared to the current market price. In addition, because the thickness of the conventional blades is same as the width of the paper to be cut, and because the location of the width define the horizontal cutting points, the narrower width of cross-section is, the smaller output power is needed to cut along the horizontal direction. In other words, the motor can supply a minimum power for cutting along the horizontal direction, that is, to reduce the power consumed by the motor. But because of the width of the paper cut by the conventional blades is 4 mm, the motor needs to output higher power to drive the blades and flanks moving in opposing directions to cut the paper along the horizontal direction smoothly.

SUMMARY OF THE INVENTION

In view of the above, this invention overcomes the shortcoming of the conventional blades.

It is a primary objective of the present invention is to provide a round undulating blade for shredders, that is integrally punched from a sheet metal in a die into a round undulating blade to effectively reduce the material cost and the weigh of the blade to thereby reduce the motor loading and power consumption.

It is a further objective of the present invention is to provide two sets of round undulating blade modules for shredders, each of which is constructed of a pair of integrally formed round undulating blades of round undulating blades that are arranged in a face-to-face and back-to-back manner, by die-casting, respectively.

It is another objective of the present invention is to provide a round undulating blade for shredders, that uses the varying curvatures of the round undulating blade to cut paper into paper chips each having a wider center tapering towards the ends, so as to reduce the power that that motor needs to output for cutting the two ends to thereby reduce the motor loading and the power consumption.

To realize the above objectives, the present invention provides a round undulating blade for a shredder, the blade comprising: a periphery; an undulating blade flank, including at least two cambers having a first curvature and at least two cambers having a second curvature alternatively arranged with respect to the cambers having the first curvature; and hooked edges formed on the periphery of the cambers having the first curvature, wherein the undulating blade flank of the blade serves to cut paper along a longitudinal direction to form paper strips having double-tapering end, and the hooked edges serve to cut the strips along a horizontal direction into paper chips.

According to one aspect of this invention, the present invention provides a round undulating blade module for a shredder, the blade module including two round undulating blades, each of the blades comprising: a periphery; an undulating blade flank, including at least two cambers having a first curvature and at least two cambers having a second curvature alternatively arranged with respect to the cambers having the first curvature; and hooked edges formed on the periphery of the cambers having the first curvature, wherein the undulating blades are arranged in such a manner that the cambers having the same curvature of each of the undulating blades face each other; and wherein the undulating blade flanks of the blades serve to cut paper along a longitudinal direction to form paper strips having double-tapering end, and the hooked edges serve to cut the strips along a horizontal direction into paper chips.

According to one aspect of this invention, the round undulating blade for shredder is characterized in that the cambers are equally spaced or unequally distant from one another.

According to one aspect of this invention, the round undulating blade for shredder is characterized in that the flank is formed with at least one rib protruding towards a direction opposing the curvature of the cambers at where the rib is formed.

According to one aspect of this invention, the round undulating blade for shredder is characterized in that the at least one rib is formed on the cambers where no hooked edges are formed.

According to one aspect of this invention, the round undulating blade for shredder is characterized in that the periphery of the blade is integrally formed into serration.

According to one aspect of this invention, the round undulating blade for shredder is characterized in that the center of the blade is formed with a polygonal hole.

According to one aspect of this invention, the round undulating blade for shredder is characterized in that the blade is made from a sheet metal punched integrally in a punching die.

According to one aspect of this invention, the round undulating blade module for shredder is characterized in that the blade module is integrally formed by die-casting.

According to one aspect of this invention, the present invention provides a round undulating blade module for a shredder, the blade module comprising; a first round undulating blade, including: a periphery; an undulating blade flank including at least two cambers having a first curvature and at least two cambers having a second curvature alternatively arranged with respect to the cambers having the first curvature; and hooked edges formed on the periphery of the cambers having the first curvature; a second round undulating blade, including: a periphery; an undulating blade flank including at least two cambers having a third curvature and at least two cambers having a fourth curvature alternatively arranged with respect to the cambers having the third curvature; and hooked edges formed on the periphery of the cambers having the third curvature; wherein the first and second undulating blades are arranged in such a manner that the cambers having the first and third curvature of each of the undulating blades face each other, and the cambers having the second and fourth curvature of each of the undulating blades face each other; and wherein the first curvature is different from the third curvature and the second curvature is different from the fourth curvature.

BRIEF DESCRIPTION OF THE DRAWINGS

The present invention will be described in further detail hereinafter, with reference to accompanying drawings.

DESCRIPTION OF THE PREFERRED EMBODIMENT

Figure 2:
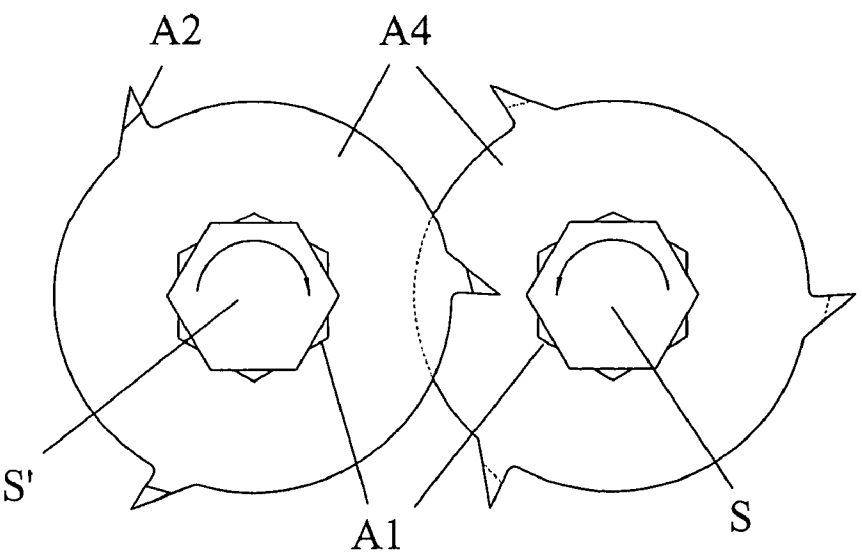
Fig. 2 Prior Art
FIG. 2 is a planar view of a conventional shredder in operation.
Figure 1:
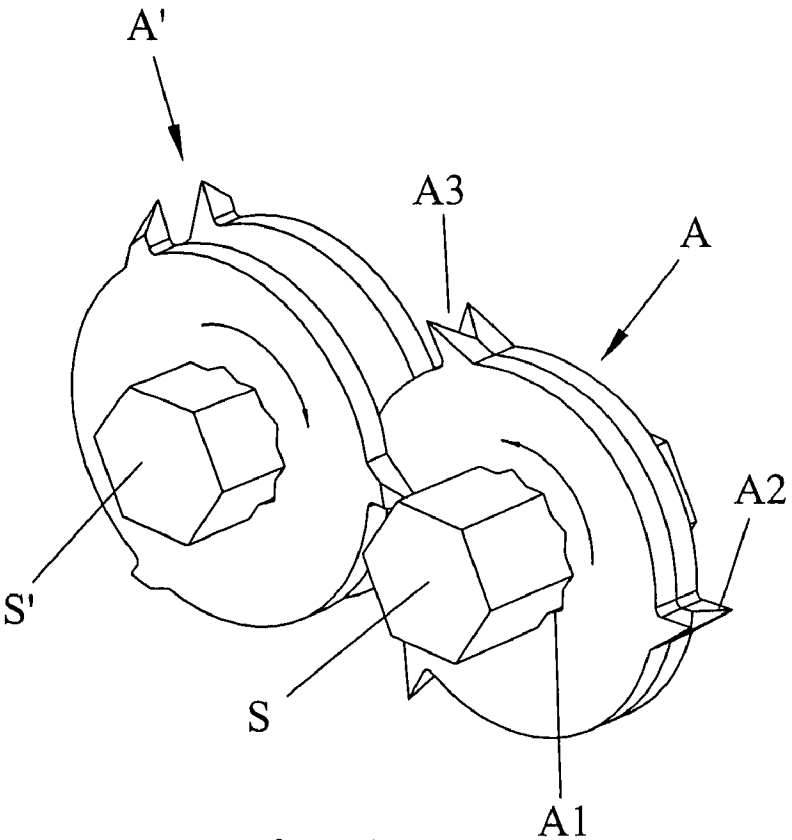
Fig. 1 Prior Art
FIG. 1 is an assembled perspective of a conventional shredder.
Figure 3:
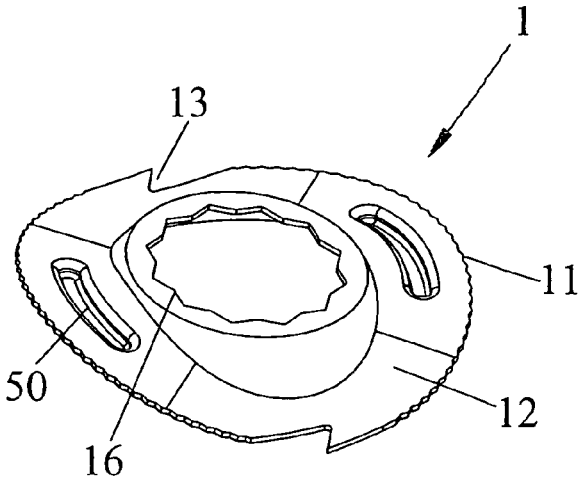
FIG. 3 is a perspective view of the round undulating blade of the present invention.
Figure 4:
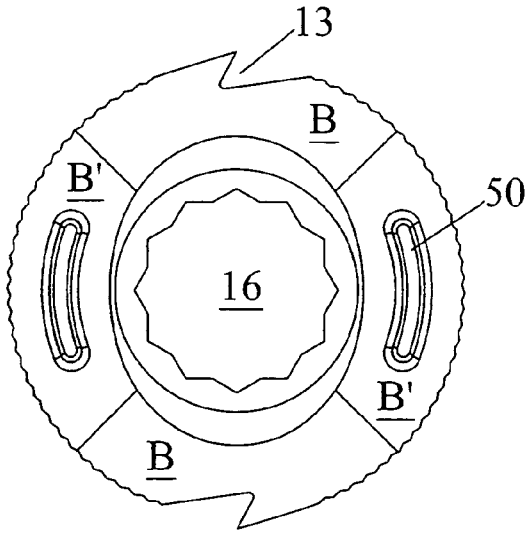
FIG. 4 is the front elevational view of the round undulating blade of the present invention.
Figure 6:
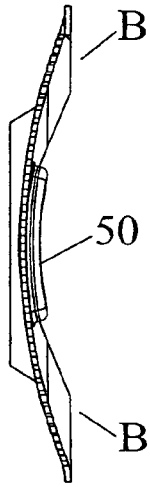
FIG. 6 is the side elevational view of he round undulating blade of the present invention.
Figure 5:
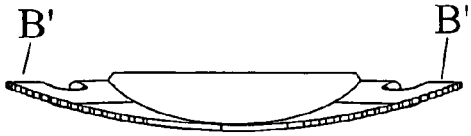
FIG. 5 is the bottom plan view of he round undulating blade of the present invention.

Please refer to FIGS. 3 to 6, where FIGS. 3 and 4 illustrate the perspective and planar views of the present invention, respectively, and FIGS. 5 and 6 are cross-sectional views taken from lines 5-5 and lines 6-6 in FIG. 4, respectively.

The above-mentioned views disclose a revolutionized cutting blade 1 for a shredder, which blade is able to provide an optimum sheet capacity based on the various types of shredders. The present invention selects a sheet metal having a minimum thickness of about 0.3 mm as a raw material, the selected sheet metal is punched by a die into a blade including an undulating blade flank 12, formed into two cambers B' having a first curvature and two cambers B' having a second curvature alternatively arranged with respect to the cambers B having the first curvature. Preferably, the cambers B, B' are equally spaced apart from one another. The cambers B, B' may also be equally spaced apart from each other, if needed. The periphery 11, as shown in FIG. 3, of the blade is integrally formed into serration. The periphery 11 of serration serves to pull the paper to be cut downwards along a longitudinal direction into strips.

As shown in FIGS. 5 and 6, the cambers B having the first curvature are integrally formed with hooked edges 13 on the periphery 11 thereof for cutting the strips along a horizontal direction into paper chips. The cambers B' having the second curvature are not formed with any hooked edges. A polygonal hole 16 is formed in a center of the blade 1, through which a rotary shaft may pass.

In this embodiment, a blade is punched in a punching die to form an undulating blade flank 12 including two cambers B having a first curvature and two cambers B' having a second curvature alternatively arranged with respect to the cambers B having the first curvature, wherein the cambers B having the first curvature are integrally formed with hooked edges 13 on the periphery 11 thereof for cutting the strips along a horizontal direction into paper chips, and the cambers B' having the second curvature are not formed with any hooked edges.

However, in case blades each of a larger dimension are needed to meet the increasing sheet capacity, the hooked edges spaced apart by 180 degrees may not sustain the larger capacity. Under such circumstances, three hooked edges that are spaced apart by 120 degrees or four hooked edges that are spaced apart by 90 degrees may also be implemented, while the four of cambers are modified into six, eight or more according to the number of hooked edges formed on the blades.

Figure 10:
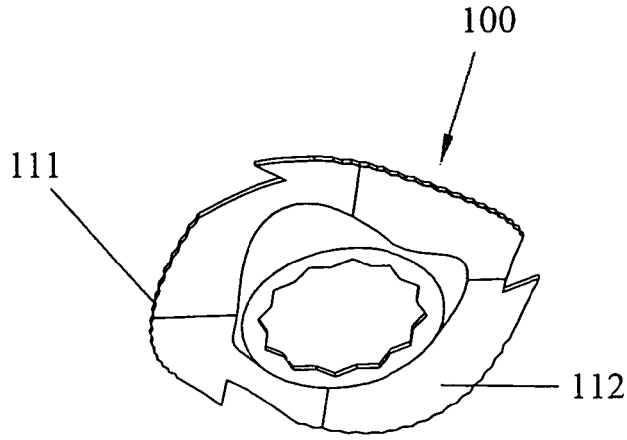
FIG. 10 is a perspective view of an alternative embodiment of the round undulating blade of the present invention.
Figure 13:
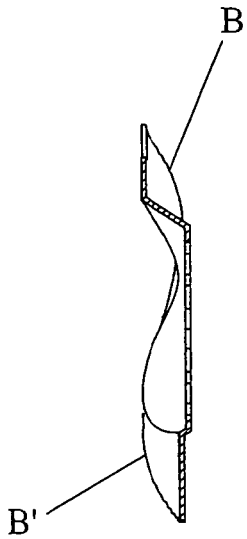
FIG. 13 is a cross-sectional view taken along lines 13-13 of FIG. 11.
Figure 11:
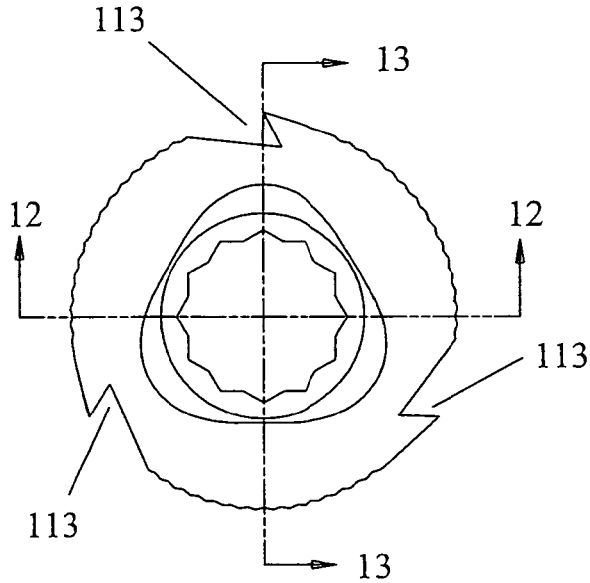
FIG. 11 is a front elevational view of the round undulating blade shown in FIG. 10
Figure 12:
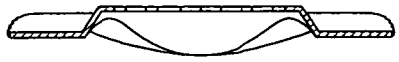
FIG. 12 is a cross-sectional view taken along lines 12-12 of FIG. 11.

FIGS. 10-13 illustrate an embodiment of a round undulating blade 100 of the present invention having six cambers. The round undulating blade 100 is punched in a punching die to form an undulating blade flank 112 including three cambers B having a first curvature and three cambers B' having a second curvature alternatively arranged with respect to the cambers B having the first curvature, as shown in FIG. 13, wherein the cambers B having the first curvature are integrally formed with hooked edges 113 on the periphery 111 thereof for cutting the strips along a horizontal direction into paper chips, and the cambers B' having the second curvature are not formed with any hooked edges. The periphery 111, as shown in FIG. 10, of the blade is integrally formed into serration. The periphery 111 of serration serves to pull the paper to be cut downwards along a longitudinal direction into strips.

Figure 9:
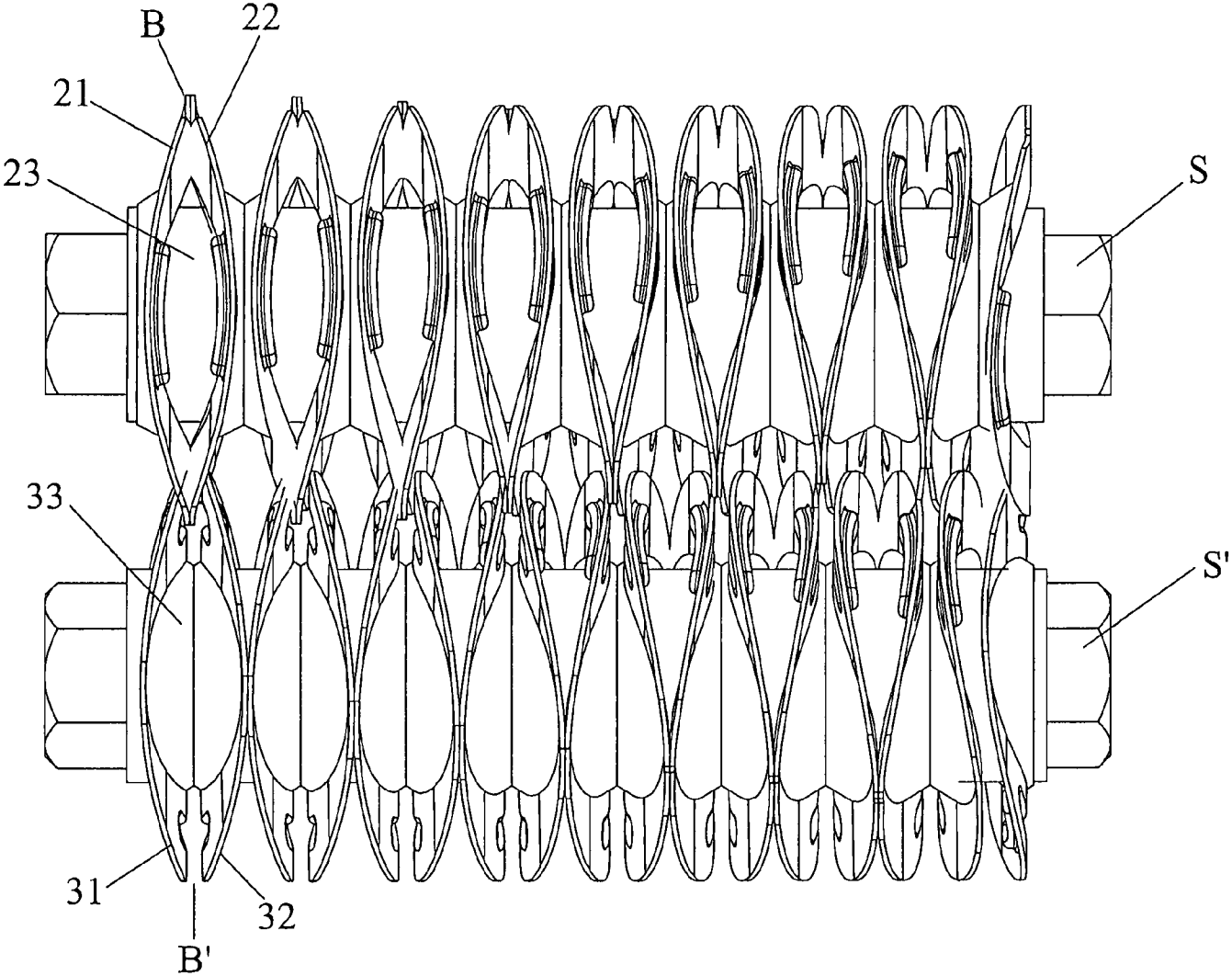
FIG. 9 is a planar view showing a plurality of blade sets being assembled to the rotary shafts.
Figure 14:
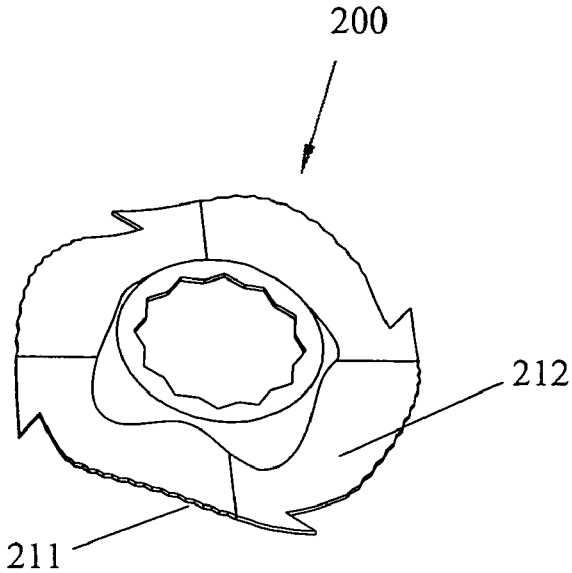
FIG. 14 is a perspective view of an alternative embodiment of the round undulating blade of the present invention.
Figure 17:
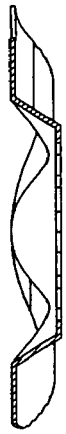
FIG. 17 is a cross-sectional view taken along lines 17-17 of FIG. 15.
Figure 15:
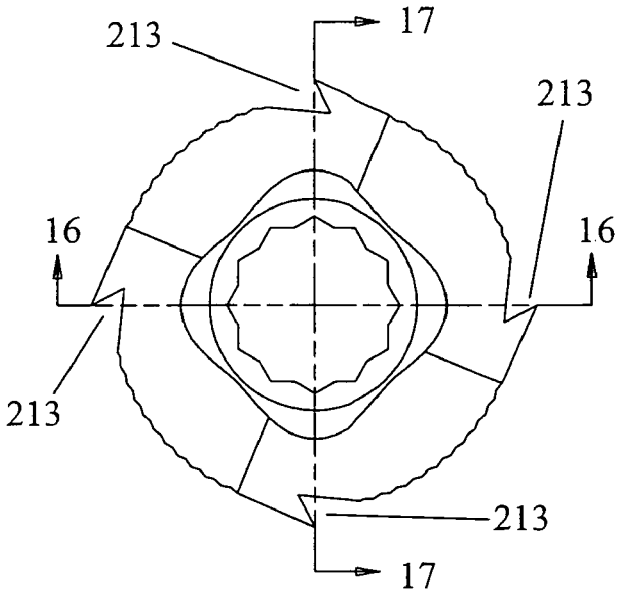
FIG. 15 is a front elevational view of the round undulating blade shown in FIG. 14
Figure 16:
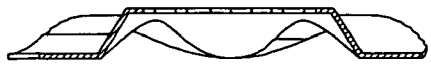
FIG. 16 is a cross-sectional view taken along lines 16-16 of FIG. 15.

FIGS. 14-17 illustrate an embodiment of a round undulating blade 200 of the present invention having eight cambers. The round undulating blade 200 is punched in a punching die to form an undulating blade flank 212 including four cambers B having a first curvature and four cambers B' having a second curvature alternatively arranged with respect to the cambers B having the first curvature (FIGS. 16 and 17 only illustrate the cambers B), wherein the cambers B having the first curvature are integrally formed with hooked edges 213 on the periphery 211 thereof for cutting the strips along a horizontal direction into paper chips, and the cambers B' having the second curvature are not formed with any hooked edges. The periphery 211, as shown in FIG. 14, of the blade is integrally formed into serration. The periphery 211 of serration serves to pull the paper to be cut downwards along a longitudinal direction into strips. With reference to FIG. 3, according to a preferred embodiment of this invention, for a round undulating blade having only two hooked edges, because the angle between the two hooked edges is relatively large, the flank 12 may be formed with a plurality of ribs 50 protruding towards a direction opposing the curvature of the cambers, by punching, at where the ribs are formed, for enhancing anti-flexing capability of the blade 4. In FIG. 3, the ribs 50 are formed on the cambers B' where no hooked edges are provided. The ribs 50 may certainly be formed on the cambers B where the hooked edges 13 are provided As shown in the assembled perspective view of the present invention in FIG. 7, the standardized round undulating blades punched from a sheet metal by a die are arranged sequentially on a first and a second rotary shafts S, S' to be assembled into the rotary cutting tool that is most important for a shredder. During assembly, the round undulating blades are arranged in such a manner that the hooked edges 13 of two adjacent blades 1 are located at the same location, and the hooked edges 13 of the blades 1 on the first rotary shaft S interlace with the hooked edges 13 of the blades 1 on the second rotary shaft S'. As shown in FIG. 9, the two adjacent round undulating blades on the first rotary shaft S are arranged in such a manner where their cambers B having the hooked edges 13 face each other to form a first blade set; the two adjacent round undulating blades on the second rotary shaft S' are arranged in such a manner where their cambers B' without the hooked edges face each other to form a second blade set.

Figure 18:
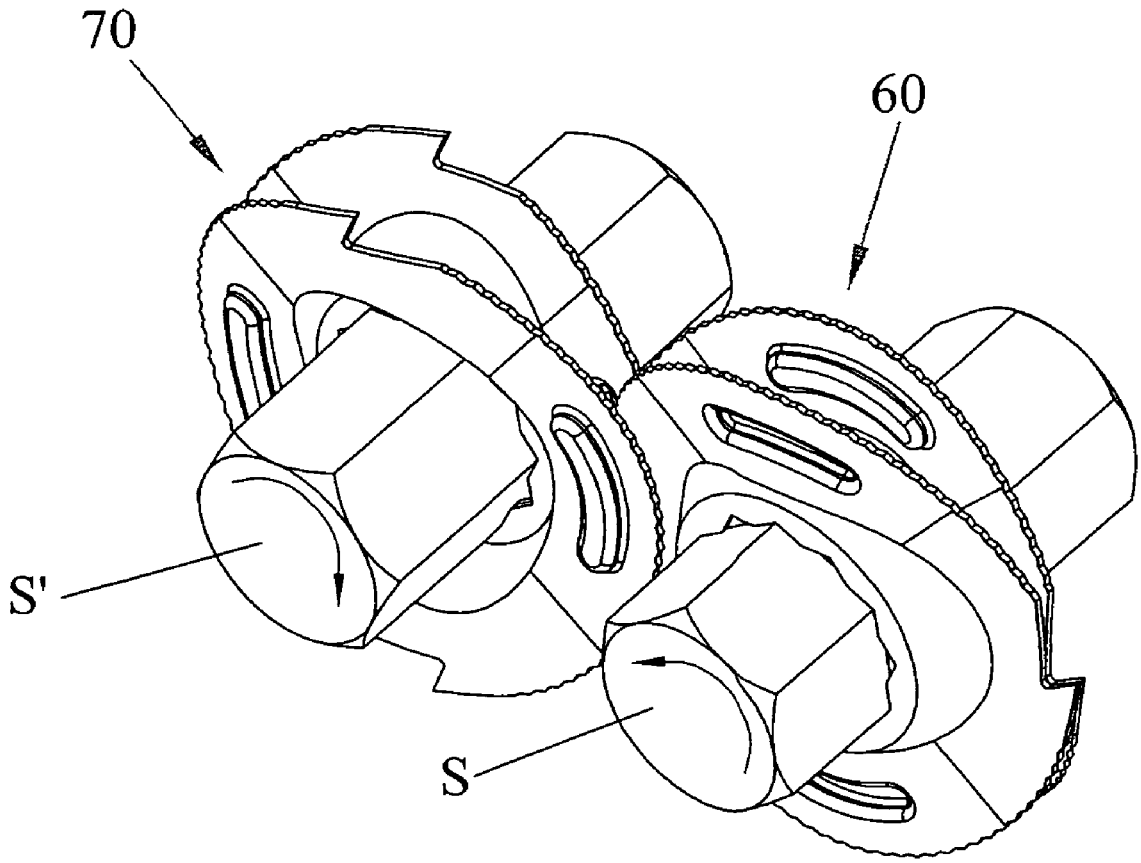
FIG. 18 is a perspective view showing round undulating blade modules of the present invention made by die-casting.
Figure 19A:
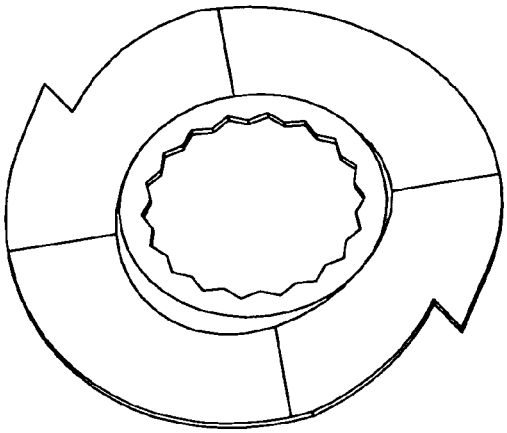
FIGS. 19*a*-19*d* are the perspective view, front elevational view, and side elevational views of a round undulating blade of the present invention with a moderate curvature.
Figure 19B:
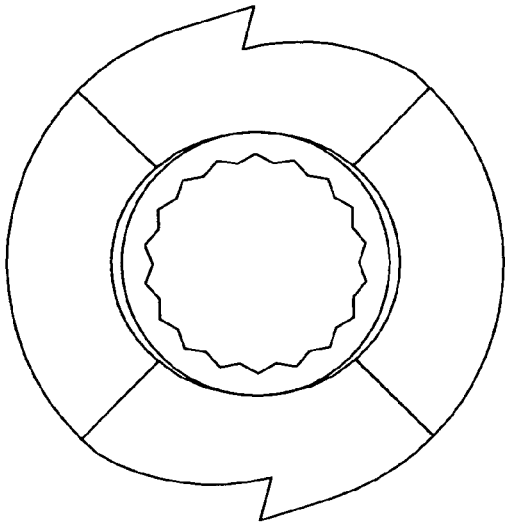
Figure 19C:
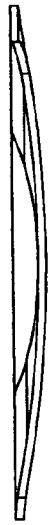
Figure 19D:
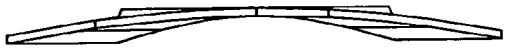
Figure 20A:
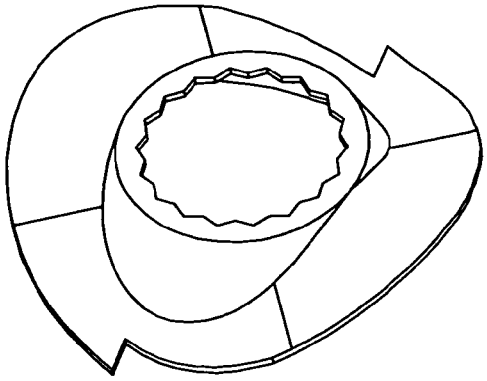
FIGS. 20*a*-20*d* are the perspective view, front elevational view, and side elevational views of a round undulating blade of the present invention with a curvature higher than that shown in FIGS. 19*a*-19*d;*
Figure 20B:
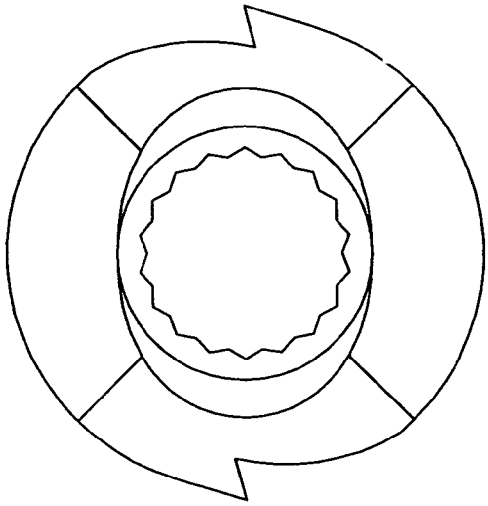
Figure 20C:
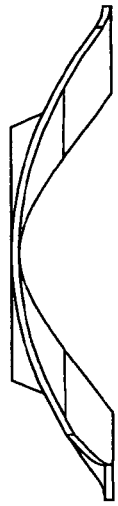
Figure 20D:
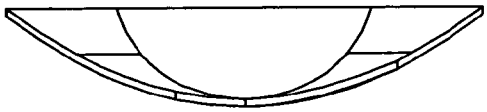
Figure 21A:
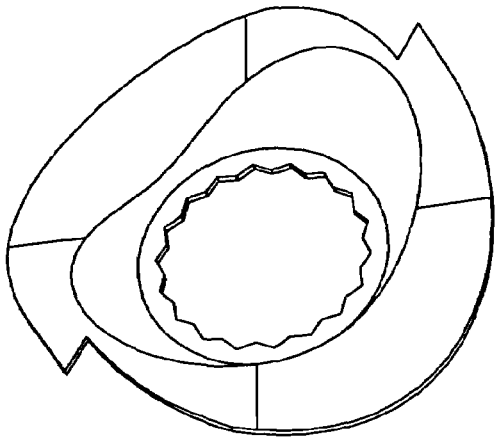
FIGS. 21*a*-21*d* are the perspective view, front elevational view, and side elevational views of a round undulating blade of the present invention with a curvature higher than that shown in FIGS. 20*a*-20*d;*
Figure 21B:
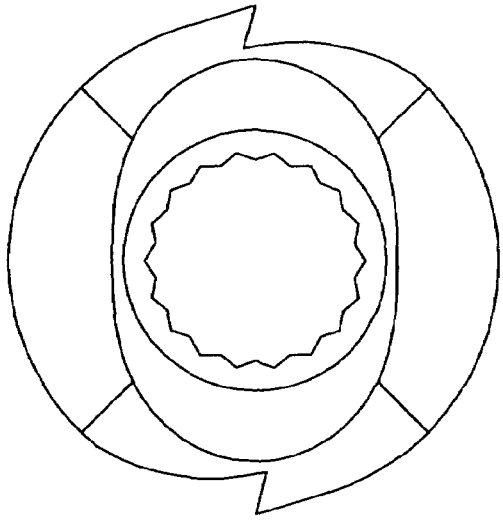
Figure 21C:
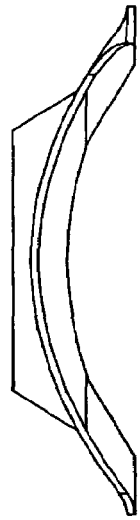
Figure 21D:
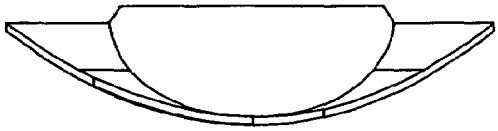

The first blade set and second blade set assembled by joining two round undulating blades to be mounted on the first rotary shaft S and second rotary shaft S', respectively, may be formed into an integral blade module by die-casting. In other words, blade modules 60, 70 configured to each have the features of the first blade set or second blade set as described above, as shown in FIG. 18, may be die-cast from their respective dies. The blade modules made by die-casting may accommodate heavy-duty shredders in exchange for their higher cost of manufacturing.

Figure 7:
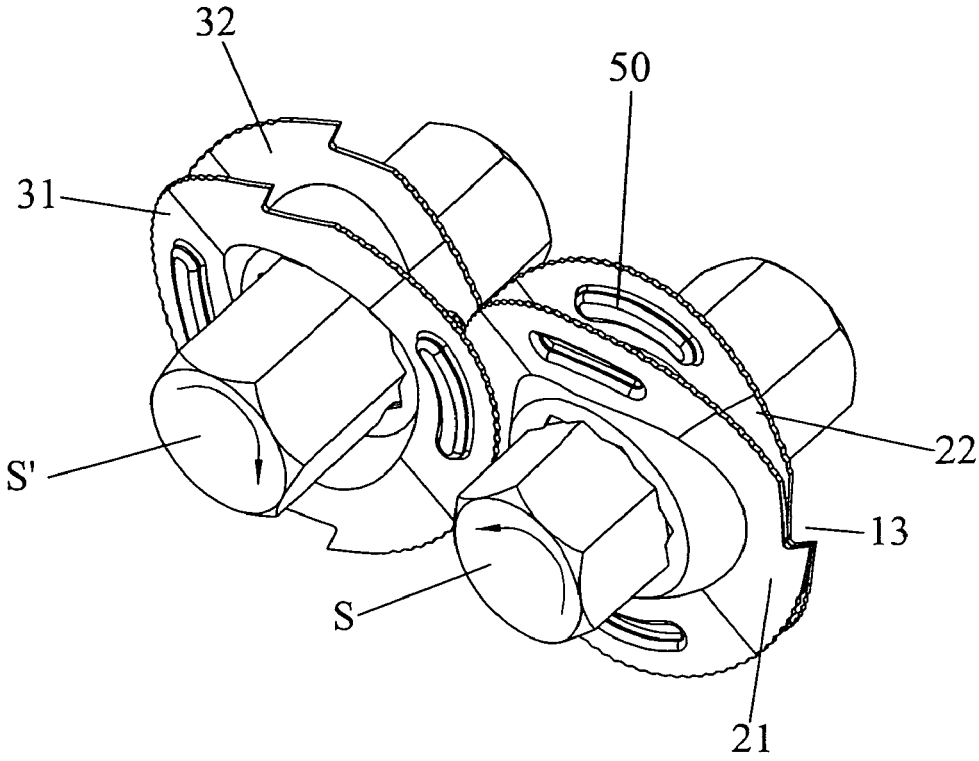
FIG. 7 is a perspective view of the round undulating blade assembled to the rotary shafts.
Figure 8:
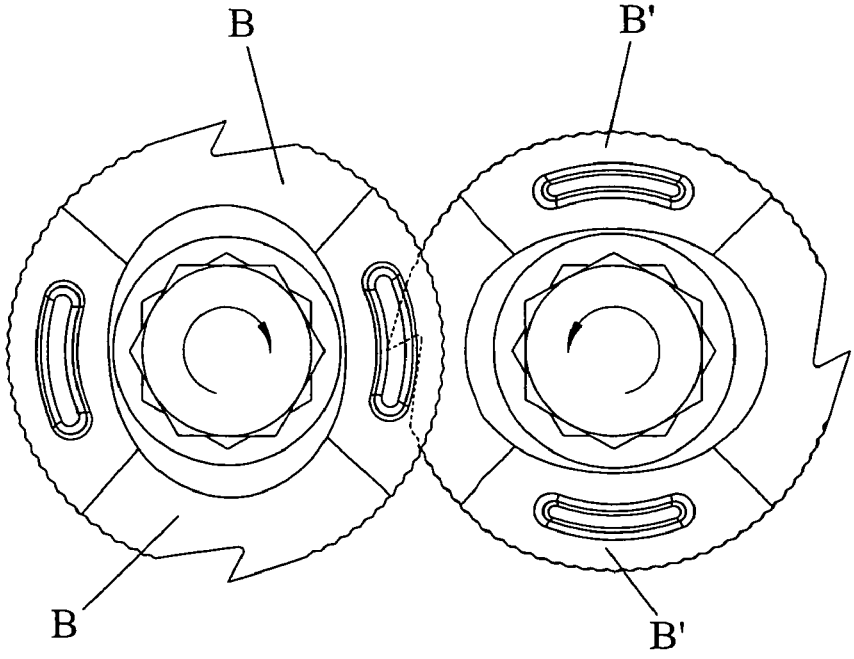
FIG. 8 is an operating view of the round undulating blade of the present invention in cutting paper.

As exemplified in FIGS. 7 and 9, the first blade 21 and the second blade 22 on a first rotary shaft S are arranged in such a manner where their cambers B having the hooked edges 13 face each other to form a first blade set. Because the flanks of the blades 21, 22 each include two cambers B having a first curvature and two cambers B' having a second curvature alternatively arranged with respect to the cambers B having the first curvature, the cambers B having the hooked edges 13 of the first blade 21 and second blade 22 join to contact each other while the cambers B' without the hooked edges of the first blade 21 and second blade 22 are separated from each other to assume an open space 23. On the other hand, the first blade 31 and the second blade 32 on the second rotary shaft S' are arranged in such a manner where their cambers B' without the hooked edges face each other to form a second blade set. Similarly, because the flanks of the blades 31, 32 each include two cambers B having a first curvature and two cambers B' having a second curvature alternatively arranged with respect to the cambers B having the first curvature, the cambers B having the hooked edges 13 of the first blade 31 and second blade 32 are separated from each other to assume an open space 33, while cambers B having the hooked edges 13 of the second blade 32 and a first blade 31' of an adjoining second blade join to contact each other. By adopting such arrangement, when the two rotary shafts S, S' rotate in opposing directions, the hooked edges of the first blade 21 and the second blade 22 on the first rotary shaft S after contacting each other adapt to insert into the open space 33 of the first blade 31 and second blade 32 on the second rotary shaft S'. When any two adjacent hooked edges contact each other, they adapt to cut strips that have been cut by the serrated edges 11 of the blades, along a horizontal direction into paper chips.

As shown in the operating view in FIG. 7 and the planar view in FIG. 9, the standardized round undulating blades each including two cambers having a first curvature and two cambers having a second curvature alternatively arranged with respect to the cambers having the first curvature, enable the flanks of the corresponding blade sets to maintain a certain contact gap at all time by means of the varying curvatures of the blades. In other words, while viewing from the rear projection, the superposition of the blades arranged on different rotary shafts are constant. Such a constant superposition can ensure scissors like cutting effects between the flanks 12 when the two rotary shafts S, S' rotate in opposing directions (shown in FIG. 9). When the cutting edges 13 formed on the periphery 11 of the cambers B contact to join each other, the hooked edges 13 will cooperate with the flanks 12 on the cambers B' of the mating blades to cut off the paper strips.

Along with the varying curvatures of the round undulating blades of this invention, the paper is fragmented into paper chips each having a wider center tapering towards the ends. Because of the two ends of the paper chip are the horizontal cutting positions, the narrower width of cross-section is, and the smaller output power is needed to cut along the horizontal direction. In other words, the motor can supply a minimum power for cutting along the horizontal direction under a minimum load. The reduction in the motor load also reduces the power consumption and increases service-life of the motor.

Figure 22A:
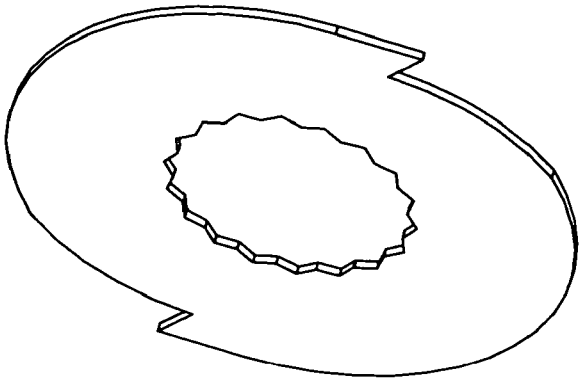
FIGS. 22*a*-22*c* are the perspective view, front elevational view, and side elevational views of a round undulating blade of the present invention with a zero-curvature, that is, a planar configuration.
Figure 22B:
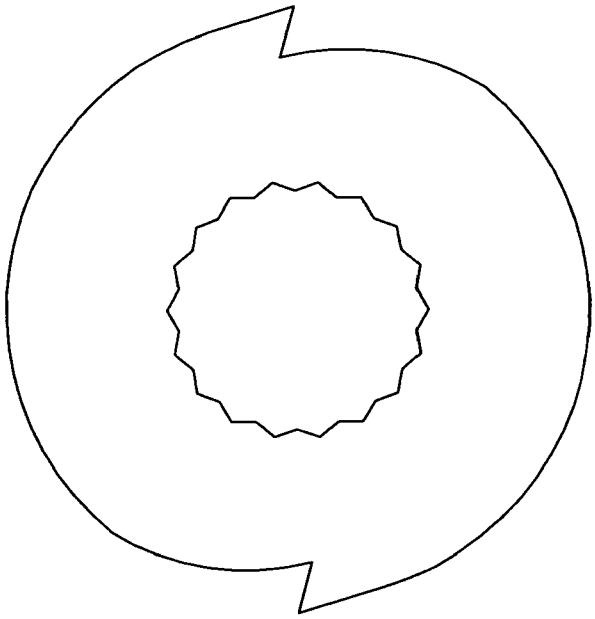
Figure 22C:
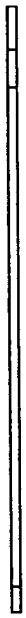
Figure 23A:
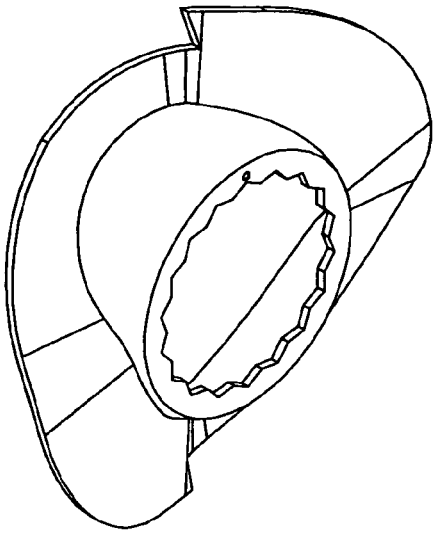
FIGS. 23*a*-23*d* are the perspective view, front elevational view, and side elevational views of a round undulating blade of the present invention with a curvature higher than that shown in FIGS. 21*a*-21*d;*
Figure 23B:
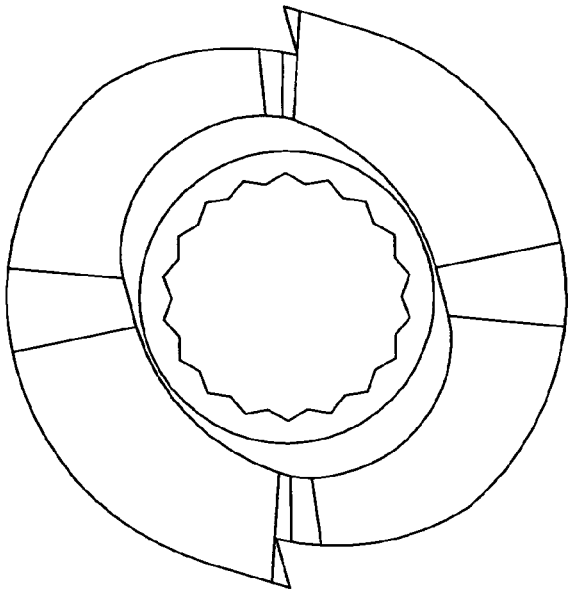
Figure 23C:
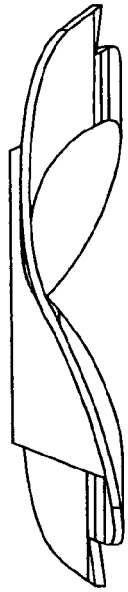
Figure 23D:
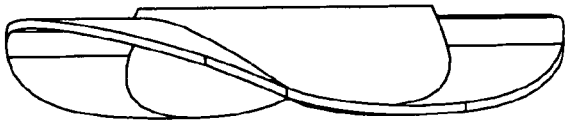

Turning to FIGS. 19-23, various round undulating blades with different curvatures, including zero-curvature, which is a planar configuration as shown in FIGS. 22*a*-22*c*. It has been observed that, a shredder adopting blade modules comprising two blade sets each having blades of different curvatures, is able to shred paper passing through the shredder into paper chips of various configurations. That is, the blade module may include a first and second round undulating blades. However, differing from the prior embodiment, the undulating blade flank of the first round undulating blade includes at least two cambers having a first curvature and at least two cambers having a second curvature alternatively arranged with respect to the cambers having the first curvature, whereas the undulating blade flank of the second round undulating blade includes at least two cambers having a third curvature and at least two cambers having a fourth curvature alternatively arranged with respect to the cambers having the third curvature. To help the shredder shred paper into paper chips of various configurations, the first and second undulating blades are arranged in such a manner that the cambers having the first and third curvature of each of the undulating blades face each other, and the cambers having the second and fourth curvature of each of the undulating blades face each other; and wherein the first curvature is different from the third curvature and the second curvature is different from the fourth curvature.

Figure 24A:
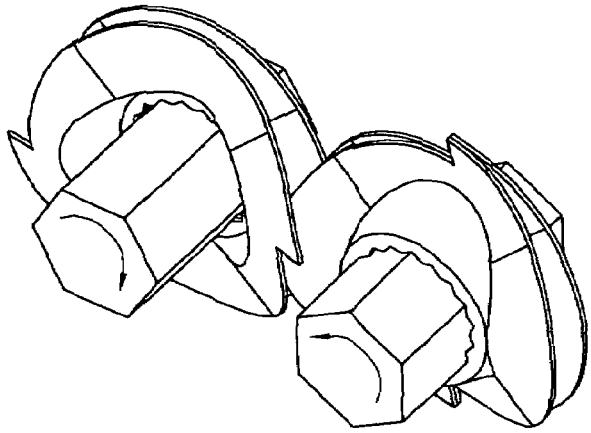
FIG. 24*a* is a perspective view showing the blade modules comprising two blade sets each including one blade shown in FIGS. 19*a*-19*d* and one blade in FIGS. 20*a*-20*d;*
Figure 24B:
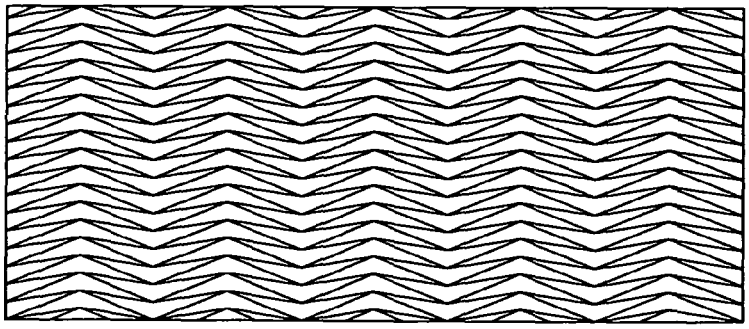
FIG. 24*b* is a schematic drawing showing the shredding lines of a piece of paper passing through the blade modules shown in FIG. 24*a;*

One example of such a blade module is shown in FIG. 24*b*. As shown, FIG. 24*b* is a schematic drawing showing the shredding lines of a piece of paper passing through the blade modules (of FIG. 24*a*) comprising two blade sets each including one blade shown in FIGS. 19*a*-19*d* and one blade in FIGS. 20*a*-20*d*, which may be referred to as "shuttle cut." In this embodiment, after mounting the two blade sets to two rotary shafts rotating in opposing directions, as previously described, the two blade module would cut any paper passing through the shredder into paper chips each having a wider center tapering towards the ends, with a shuttle-shape configuration.

Figure 25A:
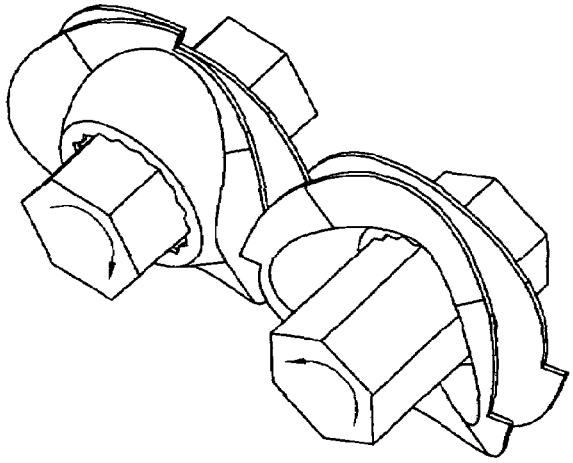
FIG. 25*a* is a perspective view showing the blade modules comprising two blade sets each including one blade shown in FIGS. 21*a*-21*d* and one blade in FIGS. 22*a*-22*c;*
Figure 25B:
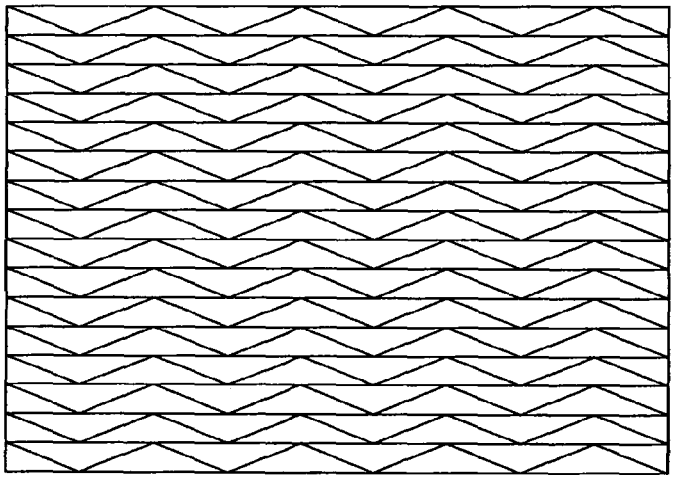
FIG. 25*b* a schematic drawing showing the shredding lines of a piece of paper passing through the blade modules shown in FIG. 25*a;*

FIG. 25*b* is another schematic drawing showing the shredding lines of a piece of paper passing through the blade modules (of FIG. 25*a*) comprising two blade sets each including one blade shown in FIGS. 21*a*-21*d* and one blade in FIGS. 22*a*-22*c* (that is, the zero-curvature blade), resulting in paper chips each having a wider center tapering towards the ends, with a triangle-shape configuration.

Figure 26A:
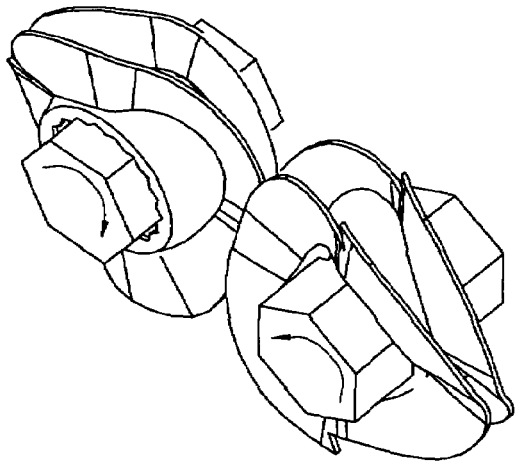
FIG. 26*a* is a perspective view showing the blade modules comprising two blade sets both including the blade shown in FIGS. 23*a*-23*d*.
Figure 26B:
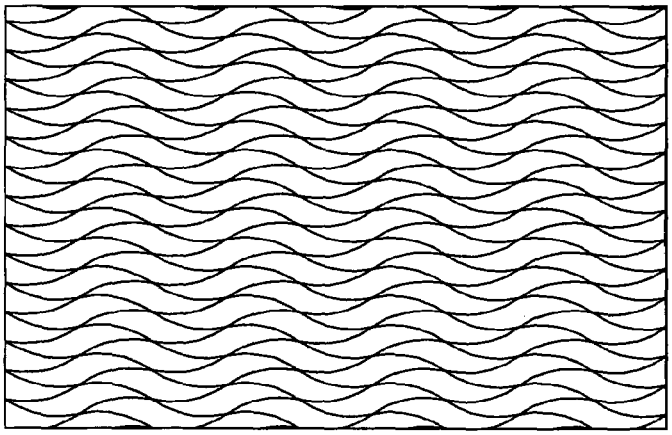
FIG. 26*b* is a schematic drawing showing the shredding lines of a piece of paper passing through the blade modules shown in FIG. 26*a*.

FIG. 26*b* is a further schematic drawing showing the shredding lines of a piece of paper passing through the blade modules (of FIG. 26*a*) comprising two blade sets both including the blades shown in FIGS. 23*a*-23*d*, resulting in paper chips each having a wider center tapering towards the ends, with a wavy-shape configuration.

As compared to the conventional blade that is punched from a sheet metal having a thickness of about 2 mm, the round undulating blade of the present invention may be punched from a sheet metal having a minimum thickness of about 0.3 mm, where the costs of the two materials are significantly different, and the reduced weight also helps to further reduce the power that the motor needs to supply to thereby increase the service life of the motor and reduce the power consumption. In addition, the round undulating blade module made by die-casting may be easily manufactured. These characteristics all help to reduce the manufacturing cost and enhance the market competitiveness.

In summary, the present invention discloses a blade punched from a sheet metal, as well as a blade module that is die-cast to form blades. In either occasion, each blade includes at least two cambers having a first curvature and at least two cambers having a second curvature alternatively arranged with respect to the cambers having the first curvature. The periphery of the blade is integrally made into serration to serve as a flank for cutting paper along a longitudinal direction. The periphery of the cambers having the first curvature is integrally formed with hooked edges for cutting the paper along a horizontal direction to form paper chips having double-tapering ends. The revolutionized construction of the present invention reduces power consumption, material cost, and lessens motor load, so as to enhance the market competitiveness of the shredder.

In the present specification "comprises means"includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

What is claimed is:

1. A round undulating blade module for a shredder, the blade module comprising;

a first round undulating blade, including:

a periphery;

an undulating blade flank including at least two cambers having a first curvature and at least two cambers having a second curvature alternatively arranged with respect to the cambers having the first curvature; and hooked edges formed on the periphery of the cambers having the first curvature;

a second round undulating blade, including:

a periphery;

an undulating blade flank including at least two cambers having a third curvature and at least two cambers having a fourth curvature alternatively arranged with respect to the cambers having the third curvature; and hooked edges formed on the periphery of the cambers having the third curvature;

wherein the first and second undulating blades are arranged in such a manner that the cambers having the first and third curvature of each of the undulating blades face each other, and the cambers having the second and fourth curvature of each of the undulating blades face each other; and wherein the first curvature is different from the third curvature and the second curvature is different from the fourth curvature.

2. The round undulating blade module for shredder according to claim 1, wherein the cambers of each of the blade flanks are equally spaced apart from one another.

3. The round undulating blade module for shredder according to claim 2, wherein the undulating blade flank of each of the undulating blades of the blade serves to cut paper along a longitudinal direction to form paper strips having double-tapering end, and the hooked edges serve to cut the strips along a horizontal direction into paper chips.

4. The round undulating blade module for shredder according to claim 1, wherein the flank of each of the round undulating blades is formed with at least one rib protruding towards a direction opposing the curvature of the cambers at where the rib is formed.

5. The round undulating blade for shredder according to claim 4, wherein the at least one rib is formed on the cambers where no hooked edges are formed.

6. The round undulating blade for shredder according to claim 1, wherein the round undulating blades are arranged in such a manner that the cambers of each of the undulating blades formed with the hooked edges join to contact each other.

7. The round undulating blade for shredder according to claim 1, wherein the periphery of each of the blades is integrally formed into serration.

8. The round undulating blade for shredder according to claim 1, wherein the center of each of the round undulating blades is formed with a polygonal hole.

9. The round undulating blade for shredder according to claim 1, wherein the blade module is integrally formed by die-casting.

* * * * *